US005892481A

United States Patent [19]

Andersson

[11] Patent Number: 5,892,481

[45] Date of Patent: Apr. 6, 1999

[54] DEVICE FOR ANTENNA UNITS

[75] Inventor: Christer Andersson, Mölndal, Sweden

[73] Assignee: Telefonaktiebolaget LM Ericsson, Stockholm, Sweden

[21] Appl. No.: 722,878

[22] Filed: Sep. 26, 1996

[30] Foreign Application Priority Data

Sep. 29, 1995 [SE] Sweden ..... 9503392

[51] Int. Cl.[6] ..... H01Q 1/38

[52] U.S. Cl. ..... 343/700 MS; 343/846; 343/848

[58] Field of Search ..... 343/700 MS, 846, 343/848, 829; H01Q 1/38

[56] References Cited

U.S. PATENT DOCUMENTS 2,998,605 8/1961 Orlando ..... 343/848

5,132,698 7/1992 Swineford ..... 343/846

*Primary Examiner*—Hoanganh T. Le

*Attorney, Agent, or Firm*—Burns, Doane, Swecker & Mathis, L.L.P.

[57] ABSTRACT

A device for antenna units consisting of one or several radiation elements for transmission and reception, respectively, of electromagnetic signals, and a ground plane arranged at a distance from said radiation element. The device includes several cooling flanges, which present edge portions facing the radiation elements, and extend at a predetermined distance to said radiation element. The edge portions are arranged at a chosen relative distance so that said edge portions together define said ground plane.

7 Claims, 3 Drawing Sheets

DEVICE FOR ANTENNA UNITS

FIELD OF THE INVENTION

The present invention relates to a device for antenna units according to the preamble of appended claim 1.

BACKGROUND TO THE INVENTION

In the construction of antennas with ground planes, the distance between the radiation elements of the antenna and the ground plane is decisive for the degree of amplification of the antenna and the bandwidth. In many cases antennas are integrated with a support structure which also carries electronics having a high power consumption and thereby gives off heat energy which has to be conducted away. Incident solar radiation also creates heat in the support structure which has to be conducted away. The space between the radiation elements and the ground plane is thereby a space which is in itself well-suited for a through-flow of cooling air. However, the distance is generally too small for allowing sufficient air-flow and at the same time fulfilling the requirements of the antenna's electrical characteristics.

If the distance between the radiation elements and the ground plane increases, the operating efficiency of the antenna is reduced, i.e. the functioning of the antenna is reduced.

SUMMARY OF THE INVENTION

The object of the present invention is to produce a device for antenna units, where high requirements on the antenna's electrical functioning are met as well as the high requirements for cooling.

Said objects are achieved by means of a device for antenna units according to the present invention, the characterising features of which are defined in appended claim 1.

By forming the ground plane as cooling flanges in accordance with the invention, which cooling flanges are also dimensioned according to the invention, the requirements on the antenna's electrical characteristics as well as the requirements for cooling are fulfilled.

BRIEF DESCRIPTION OF THE DRAWINGS

The invention will now be described in more detail by means of certain embodiments and with reference to the accompanying drawings, in which.

DESCRIPTION OF PREFERRED EMBODIMENTS

Figure 1:
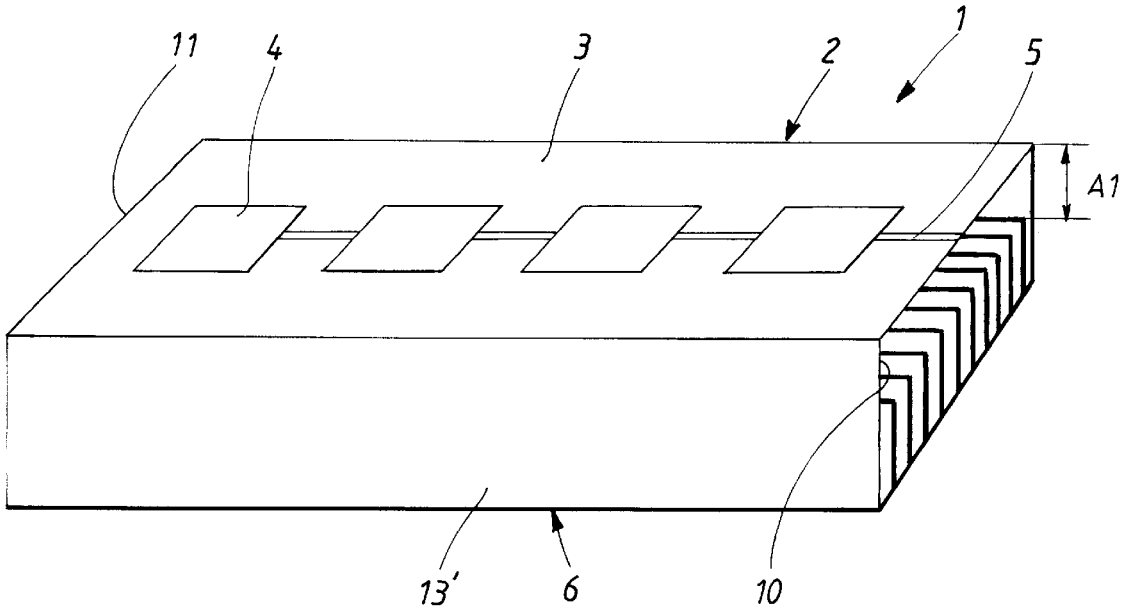
FIG. 1 shows a perspective view of an antenna unit according to a first embodiment of the invention.
Figure 2:
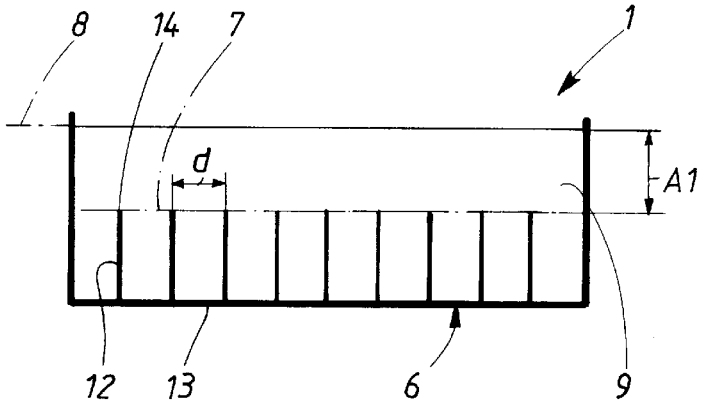
FIG. 2 shows a schematic end view of the antenna unit according to FIG. 1.

FIGS. 1 and 2 thus show, very schematically, an antenna unit 1 for electromagnetic radiation in a first embodiment and consisting of a support structure 2 which comprises a disc-formed support 3 of an electrically insulating material, for example a plate of relatively stiff material, e.g. glassfibre laminate or polymer material, which supports an electrically-conductive layer forming a circuit pattern, produced for example by etching of a copper laminate, i.e. a plate of the PC-plate type or printed circuit plate. The insulating plate 3 supports a plurality of radiation elements 4 which are flat, i.e. they have a disc-shaped extent and are for example of the microstrip antenna type for microbase-stations within the field of mobile telephony. The antenna in the shown example thus operates within the microwave range, i.e. in the order of about one GHz and upwards. Supply conductors 5 for the antenna elements are also arranged using the same technique. The emitted signal can for example be polarised with horizontal or vertical polarisation, or can possess both polarisation types.

The support structure 2 further comprises an electrically-conductive part 6 which is constructed as a casing and thereby forms a mechanical protector as well as an electrical shield. The shielding function also includes the electrically conducting part 6 defining a ground plane 7 included in the antenna unit 1, said ground plane extending parallel to the main plane 8 of the radiation elements 4, i.e. substantially parallel with the plane of the carrier laminate 3. The ground plane 7 will be described in more detail below. Its extent in the plane 7 is limited by two side portions 13 projecting from a base portion 13, said side portions carrying the support 3 for the radiation elements 4.

The antenna unit 1 is normally subjected to different heat sources; for example upon being placed outside, solar radiation on the radiation elements (the patches) or the surrounding radome can lead to a rise in temperature, which means that the heat has to be conducted away in order for the unit to work under favourable temperature conditions. Additionally, the antenna unit can support energy-consuming electronic components which thereby give off heat which has to be conducted away. For this purpose a space 9 is arranged between the carrier 3 for the radiation elements and the electrically-conducting support structure 6, said space being arranged to allow through-flow of cooling air. For this purpose, the space presents an inlet 10 at one end of the antenna unit 1 and an outlet 11 at the opposite end of the unit, whereby either a fan is arranged for driving the air stream through the space or self-circulation is arranged, for example by the antenna unit 2 being arranged to be standing, with for example the inlet 10 placed downwards and the outlet 11 placed upwards in the unit. In order to increase the heat-emitting surface, the support structure 6 is formed with a plurality of cooling flanges 12 which start from the base portion 13, which forms a rear wall in the support structure and ends with a longitudinal edge portion 14 which forms the flanges' top and extends substantially parallel with the main plane 8 of the radiation elements 4.

In order to achieve the necessary cooling, the air space 9 has to have such dimensions, i.e. cross-sectional area, that the air-flow is sufficiently large, otherwise the air will be thermally-insulating. At the same time, it is desirable to achieve a high efficiency of the antenna and a certain bandwidth, which parameters are dependent upon the radiation elements' distance or the antenna elements' distance to the ground plane 7. In order to simultaneously meet the desire of having good cooling and good electrical characteristics for the antenna, a respective distance between the cooling flanges 12 has been chosen in accordance with the invention to be so small that the edge portions 14 or tops of the cooling flanges will together define the ground plane 7 and thereby raise the ground plane from the base part 13 to the plane 7. The condition for the flange tops to form the ground plane is that the cooling flanges' distance d is less than 0.25λ and is preferably about 0.1λ, where λ is the wavelength of the signal emitted from the antenna elements 4. When this condition is fulfilled, the distance of the ground plane is thus moved to a suitable chosen distance A1.

Figure 3:
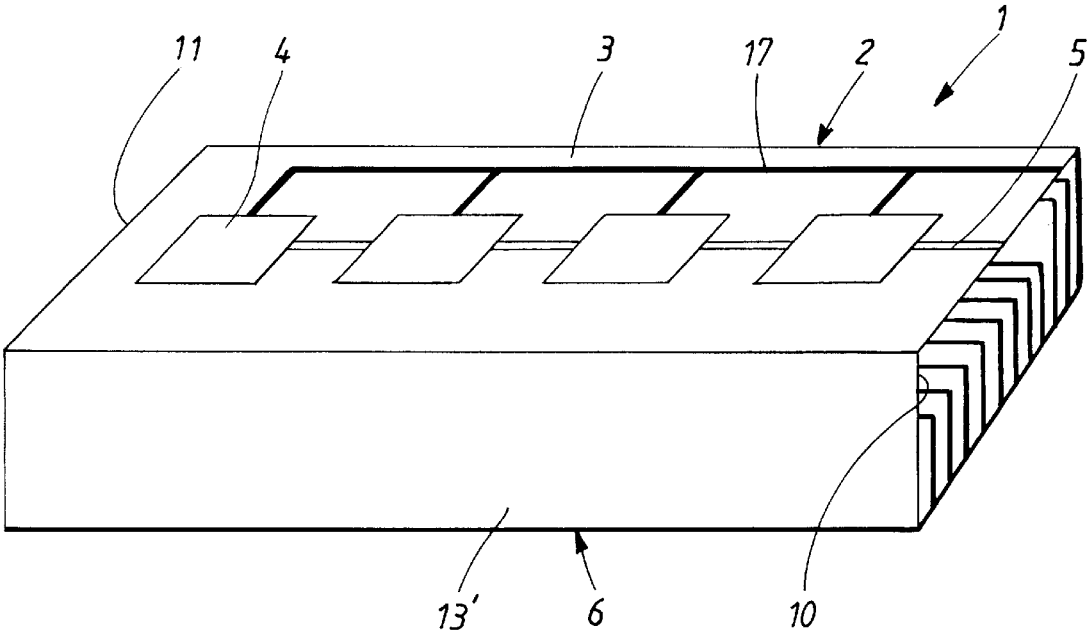
FIG. 3 shows a schematic perspective view of the antenna unit according to a second embodiment.
Figure 4:
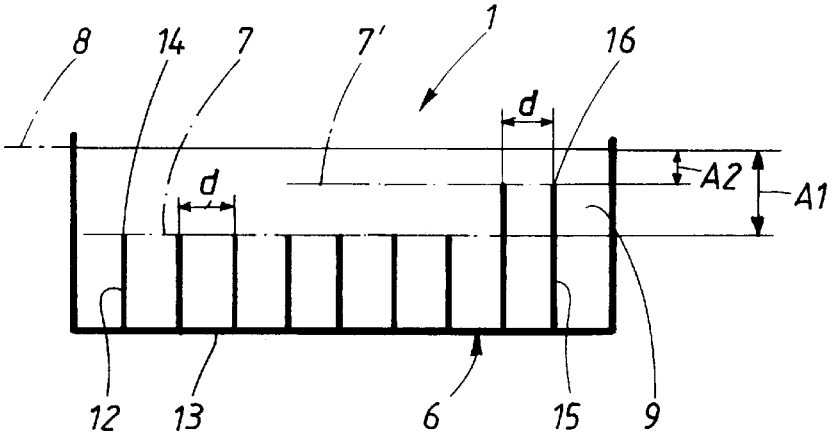
FIG. 4 shows a schematic end view of the antenna unit according to FIG. 3

FIG. 3 and 4 show a second embodiment of the antenna unit 1, from which it is clear that different ground plane distances A1 and A2 and therewith different ground planes 7, 7' can occur in one and the same antenna unit. This is achieved in the shown embodiment by a second group of cooling flanges 15 with edge portions 16 or flange tops being arranged over a portion of the support structure 6, these extending substantially parallel with the antenna plane 8, but at a varying distance from the edge portions 14 of the radiation elements. These flanges 15 should also fulfil the requirement of respective gaps between the flanges 15, namely $d<0.25\lambda$ and preferably about 0.1λ. It may be desirable to select a smaller ground plane distance A2 over one section, positioned behind the supply conductors 17 to the antenna elements 4 in order that they will radiate as little as possible.

Figure 5:
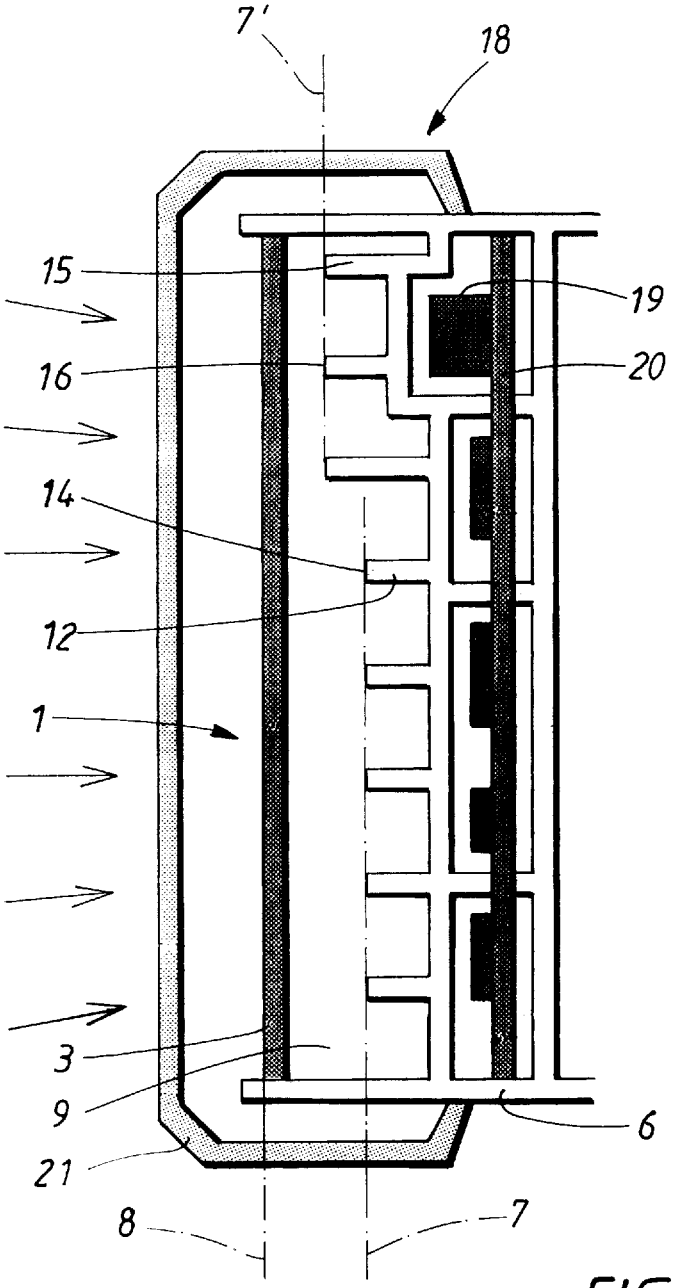
FIG. 5 shows an end view of an electronics unit substantially in accordance with the second embodiment.

FIG. 5 shows an electronics unit 18 viewed from above which comprises the antenna unit 1 and moreover supports a number of electronic components 19 carried on support 20, such as a circuit board. The electronic components 19 are positioned in a space behind the air space 9 between the carrier 3 for the antenna elements and the electrically-conducting and shielding part 6 of the support structure, which for example is formed by an extruded aluminium profile. A radome 21 is connected to the support structure 6, said radome forming an environmental protector for the antenna unit 1 and at the same time allowing passage therethrough of electromagnetic radiation.

The antenna unit 1 is normally used as a combined transmitter and receiver antenna, whereby the antenna is completely reciprocal concerning its characteristics.

The invention is not limited to the embodiments described above and shown in the drawings but can be varied within the scope of the appended claims. For example, the cooling flanges 12, 15 within each section can have respectively different heights, for example every second flange can be longer than the adjacent flange, whereby however the requirement concerning the space between the tops of the flanges still has to be fulfilled. By use of additional sections with different flange height, more than one, two, three or more ground planes can be arranged in the same antenna unit. Even though the shown embodiments relate to wavelengths within the microwave range, the invention operates completely independently of wavelength.

What is claimed is:

1. Device for antenna units comprising: one or more radiation elements for transmitting and receiving, respectively, electromagnetic signals; and a ground plane positioned at a distance from said radiation elements, wherein a number of cooling flanges extend at a predetermined distance to said radiation elements, said cooling flanges presenting edge portions, facing towards the radiation elements, which edge portions are arranged with a chosen respective distance, in order that said edge portions together define said ground plane.

2. Device according to claim 1, wherein said respective distance is less than about 0.25λ, where λ is the wavelength of the signal transmitted or respectively received by the radiation elements.

3. Device according to claim 2, wherein the respective distance between the cooling flanges is about 0.1λ.

4. Device according to claim 1, wherein the cooling flanges extend with at least two different distances from the radiation elements, thereby defining at least two different ground planes.

5. Device according to claim 1, wherein the cooling flanges are supported by an electrically-conducting carrier structure which, together with an electrically insulating carrier for the radiation elements, delimits an air space, into which the cooling flanges project and which is arranged to allow an air current flow therethrough.

6. Device for antenna units comprising: one or more radiation elements lying in a first plane for transmitting and receiving, respectively, electromagnetic signals; and a ground plane positioned at a distance from said radiation elements and substantially parallel to said first plane, wherein a number of cooling flanges extend at a predetermined distance to said radiation elements, said cooling flanges presenting edge portions, facing towards the radiation elements, which edge portions are arranged with a chosen respective distance, in order that said edge portions together define said ground plane.

7. The device of claim 6, wherein said cooling flanges are substantially perpendicular to said first plane.

* * * * *